United States Patent [19]

Martin

[11] Patent Number: 4,926,554

[45] Date of Patent: May 22, 1990

[54] COLLAPSIBLE KNIFE

[75] Inventor: Wayne C. Martin, Inverness, Ill.

[73] Assignee: Charles L. Martin, Inverness, Ill.

[21] Appl. No.: 398,251

[22] Filed: Aug. 24, 1989

[51] Int. Cl.[5] ..... B26B 3/06

[52] U.S. Cl. ..... 30/161; 30/331

[58] Field of Search ..... 30/160, 161, 58, 330, 30/331

[56] References Cited

U.S. PATENT DOCUMENTS

| | | | |
|---|---|---|---|
| 1,667,462 | 4/1928 | Logan | 30/161 X |
| 1,782,901 | 11/1930 | Kassel | 30/161 X |
| 1,965,291 | 7/1934 | Kowald | 30/160 |
| 4,606,123 | 8/1986 | Wrench | 30/161 X |

*Primary Examiner*—Douglas D. Watts

*Attorney, Agent, or Firm*—Edmond T. Patnaude

[57] ABSTRACT

A clasp knife has a pivotally mounted blade which can be swung between an operative extended position and a shrouded position within a body and handle using only one hand. The knife incorporates an actuating lever carrying a latching dog which locks the blade to the lever when the blade and the body are swung from the closed position to the open position while a release member is in a locking position. When the body is swung to the extended position while the release member is in the release position, the latching dog is released from the blade and the blade is detained in the body as the body is swung back to the inoperative closed position.

6 Claims, 2 Drawing Sheets

COLLAPSIBLE KNIFE

The percent invention relates in general to pocket knives having a blade which is pivotable between an extended operative position and a collapsed or folded position where it is shrouded within a protective body, and it relates more particularly to a new and improved pocket knife in which the blade can be moved between the open and closed positions using only one hand.

BACKGROUND OF THE INVENTION

Conventional pocket knives usually incorporate one or more blades which are pivotably movable from a shrouded position in an open cavity in an elongate protective body, which also functions as a handle, to an extended operative position. Such knives generally include over-center type spring mechanisms which retain the blades in both the closed and open positions. Knives of this type are adapted to be opened and closed by firmly holding the knife body in one hand while using the other hand to pivot the blade between the open and closed positions.

There are many occasions when the user of a knife has only one hand available for holding and opening the knife as, for example, when hunting or fishing. It would, therefor, be desirable to provide a pocket knife which can be held and opened with the same hand. Such a knife should also be safe to handle, and it should be sturdy in construction so as to be usable under adverse conditions.

SUMMARY OF THE INVENTION

Briefly, there is provided in accordance with the present invention a new and improved clasp knife having a combined body and handle in which a blade and an actuating lever are pivotally mounted for movement of the blade between a shrouded position within an open cavity in the knife body and an operative unshrouded position where it extends from one end of the body. When the blade is pivoted from the closed position to the extended open position, a latching dog which is carried by the actuating lever is spring biased into a notch in the blade to lock the blade in the operative position.

A finger actuated lock release member is slidably mounted to the body for movement between a locking position out of engagement with the latching dog and a release position where it is positioned to intercept the latching dog and cam it out of the notch in the blade as the body is swung from an extended position relative to the lever in which it shrouds the blade to a position wherein the lever lies alongside the blade receiving cavity in the body.

A detent is carried by the body for engagement with the blade when the latter is disposed within the cavity in the body to detain the blade within the cavity except when the blade is physically forced out of the cavity during the blade opening operation.

In a preferred embodiment of the invention, the lever is provided with a finger gripping portion, such as one or more finger loops, to facilitate the holding of the lever while the body and blade are swung relative to the lever to pivot the blade and body between the open and closed positions. During such swinging movement of the body and blade from the closed position to the open position while the release member is in the locking position, the momentum of the body overcomes the detention force of the detent and carries the body away from the blade which is latched to the actuating lever. With the release member in the release position, as the body is swung over the blade the latching dog is cammed out of the notch in the blade so that when the body is swung back to its original position adjacent the actuating lever, the blade is retained therein by the detent in the cavity in the body and is carried back to its closed position alongside the lever.

GENERAL DESCRIPTION OF THE DRAWINGS

Further objects and advantages and a better understanding of the present invention will be had by reference to the following detailed description taken in connection with the accompanying drawings wherein.

DETAILED DESCRIPTION OF A PREFERRED EMBODIMENT OF THE INVENTION

Figure 1:
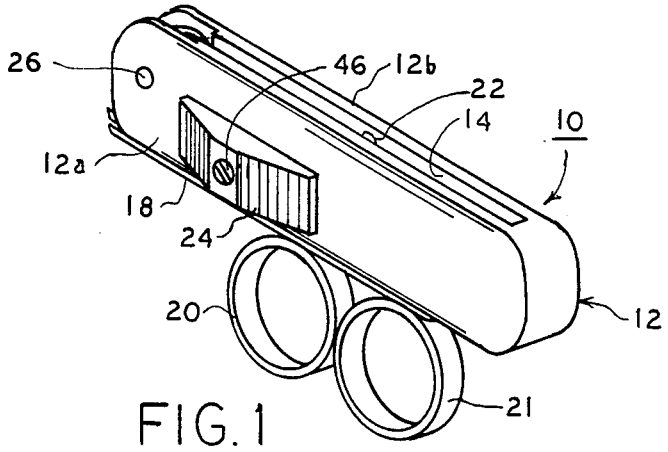
FIG. 1 is an isometric view showing a clasp knife embodying the present invention in a closed condition.

Referring particularly to FIG. 1, a pocket knife 10 includes as its principal elements an elongate combination body and handle 12 having an open cavity 14 therein for receiving a blade 16 (FIG. 2), an actuating lever 18 having a pair of finger loops 20 and 21, a blade retaining detent 22, and a finger actuated lock release button 24 which is slidably mounted on the body and handle member 12. The blade 16 and the actuating lever 18 are pivotally mounted to the body 12 by a pintle 26 in the form of a screw which extends through the body and handle member 12 between parallel walls **12*a* and 12*b* thereof and through mutually aligned holes in the blade 16 and in the actuating lever 18. As may be best seen in FIG. 2, a second detent 28 is mounted to the body and handle member 12 for engagement with a notch 30 (FIG. 6) in the side of the actuating lever 18 when the actuating lever is positioned over the mouth of the cavity 14 in the body and handle member 12 as shown in FIGS. 1, 2, 6 and 8**.

Figure 2:
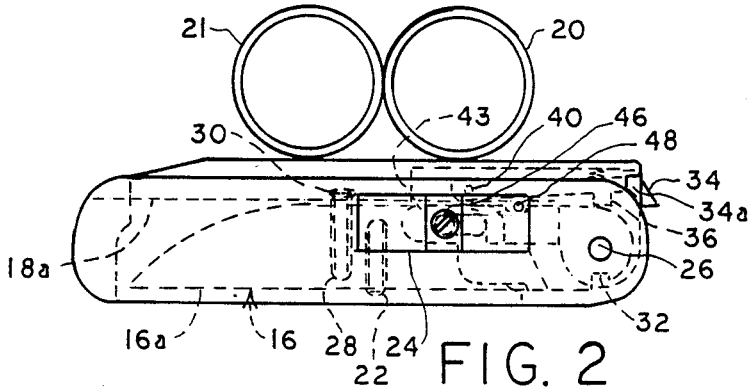
FIG. 2 is a side view of the knife of FIG. 1 showing the knife in a closed position with the blade shrouded in the body of the knife.
Figure 3:
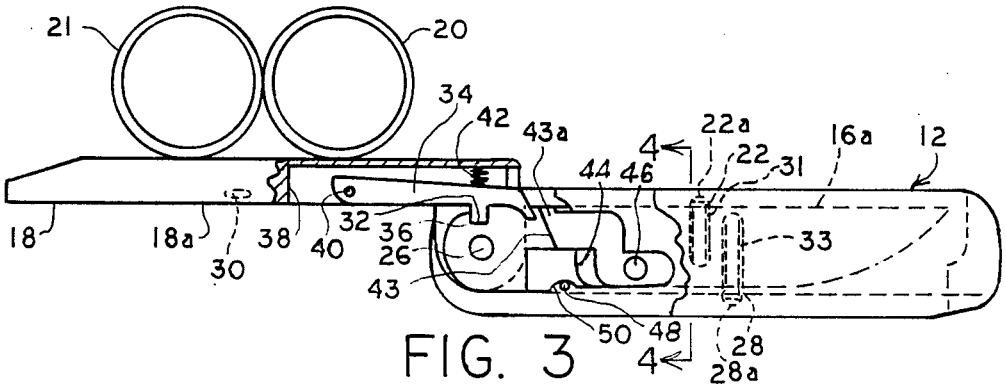
FIG. 3 is a side view partly broken away, of the knife of FIG. 1 showing the body and blade in an extended position relative to the actuating lever of the knife and with the release member in the locked position.
Figure 4:
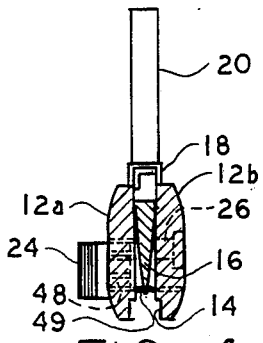
FIG. 4 is a cross-sectional view taken along the line 4—4 of FIG. 3.
Figure 6:
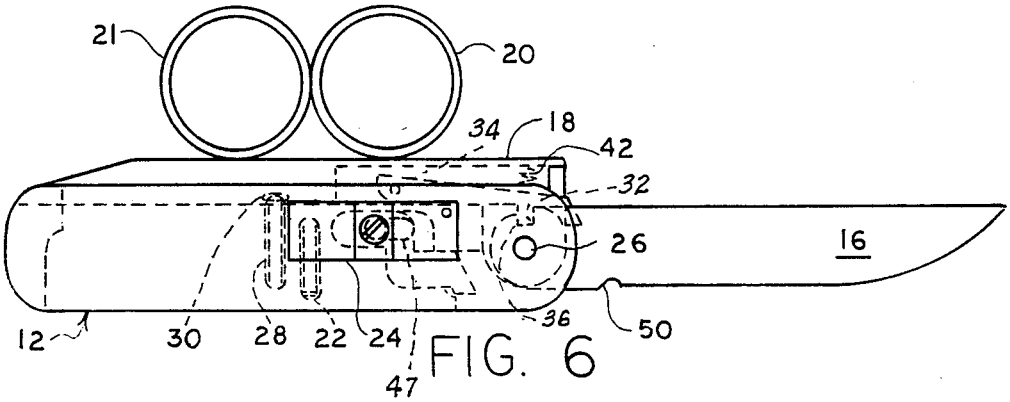
FIG. 6 is a side view similar to that of FIG. 3 but with the blade locked in the extended open position.

As will be better understood as this description proceeds, when the knife is in an open operative position, the blade 16 is latched to the actuating lever 18 in a extended position as best shown in FIG. 6. To this end, a radial notch 32 is provided in the edge of the blade 16 in proximity to the pintle 26, and a latching dog 34 is pivotally attached to the actuating lever 18 for locking reception in the notch 32 when the blade 16 is in an extended position relative to the actuating lever 18. In FIG. 2 the latching dog is shown in a released position with a latching lug 36 thereof displaced from the notch 32. In FIG. 3 the blade 16 is shown in an extended operative position relative to the actuating lever 18 wherefore the lug 36 is disposed in the notch 32 to prevent relative rotation between the blade 16 and the actuating lever 18.

Figure 8:
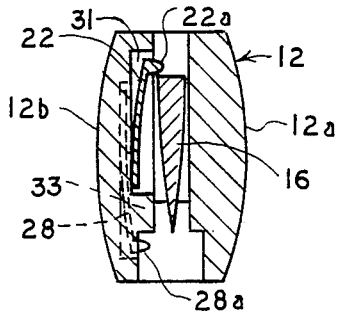
FIG. 8 is a cross-sectional view taken along the line 8—8 of FIG. 7 particularly showing the construction of the detents which hold the blade and the actuating lever within the cavity of the knife body.
Figure 5:
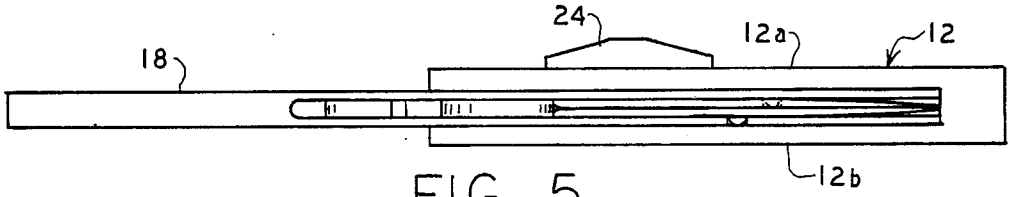
FIG. 5 is a view taken from the bottom of FIG. 3.

As shown best in FIG. 8, the detents 22 and 28 are flat springs respectively mounted in a pair of slots 31 and 33 provided in the inner surface of the body wall 12*b*. The spring 22 has an offturned distal end 22*a* which is spring biased over the rear edge 16*a* of the blade 16. The spring 28 has an offturned distal end 28*a* which is spring biased into the notch 30 in the actuating lever 18.

With particular reference to FIG. 3 it will be seen that the latching dog 34 is located in an elongate recess 38 provided in the lever 18 and is attached to the lever by a pivot pin 40. A coil spring 42 is compressed between the bottom of the recess 38 and the latching dog 34 to bias the lug 36 toward the edge of the blade 16 and thus into the notch 32 when the blade is positioned with the notch 32 opposite the lug 36.

Figure 7:
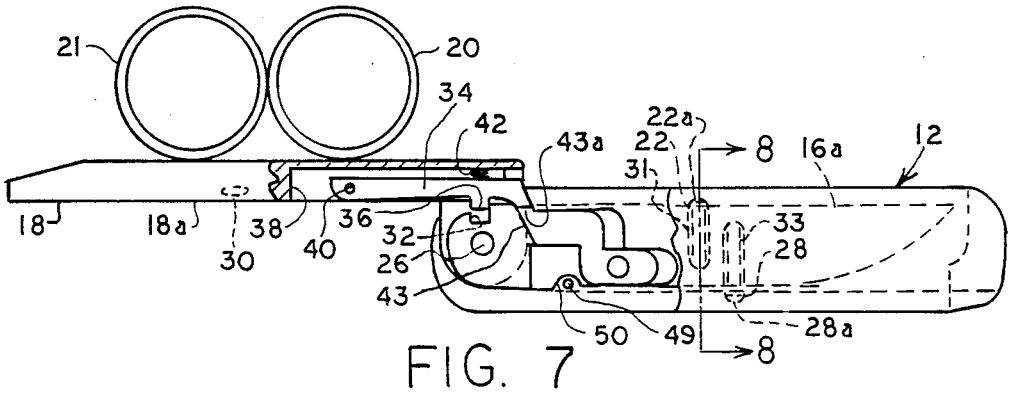
FIG. 7 is a side view similar to FIG. 3 but with the release member in the release position.

In order to lift the lug 36 out of the notch 32, a release member 43 is mounted in a recess 44 in the inner face of the body wall 12*a* for linear sliding movement toward and away from the pintle 26. The release member 43 is fixedly connected to the release button 24 by means of a machine screw 46 which extends through a hole in the button 24 and is threadly received in a bushing portion 48 of the member 43. The screw 46 extends through a longitudinally extending slot 47 in the body wall 12*a*. The release member 43 has a finger portion 42*a* at its end which is positioned beneath the distal end portion of the lever 18 when the release member is in the release position as shown in FIG. 7.

In order to hold the cutting edge of the blade away from the bottom surface 18*a* of the lever, a stop pin 48 extends between the walls 12*a* and 12*b* of the body and engages the edge of a notch 50 in the edge of the blade 16 when the blade is in the fully shrouded position in the body. Consequently, when the blade 16 is within the cavity 14 it is retained between the stop pin 48 and the spring detent 22.

OPERATION

In order to open the knife 10, the knife is held by inserting the fingers of the user through the loops 20 and 21, sliding the release button 24 in the direction away from the pintle 26 to move the release member 43 to the locking position shown in FIG. 3, and then swinging the body and the enclosed blade from the closed position shown in FIG. 2, to the position shown in FIG. 3. When the notch 32 moves below the lug 36 on the latch dog 34, the lug 32 is pushed by the spring 42 into the notch 32 to lock the blade to the lever 18. The blade 16 and the body 12 are in an extended position relative to the actuating lever at this time.

The body is then swung back to the position shown in FIG. 6 wherein the lever 18 overlies the open side of the cavity 14 and is engaged by the detent 28 which thus holds the lever 18 and the body 12 in the illustrated position with the locked blade in the extended operating position.

In order to close the knife, i.e. shroud the blade in the body, it is merely necessary to slide the release button 24 toward the pintle 26 to move the release member 43 to the release position shown in FIG. 7 wherein the finger 43*a* at the end of the release member 43 is positioned to engage the end portion 34*a* of the latching dog as the body 12 is swung from the position shown in FIG. 6 to the position overlying the blade as shown in FIG. 7. As may be seen in FIG. 7 when the body 12 has been swung from the position shown in FIG. 6 to that shown in FIG. 7 the lug 36 has been cammed out of the notch 32 by the release member 43 so that when the body 12 is subsequently swung back to the position shown in FIG. 2 the blade is free to pivot relative to the lever 18, and being retained in the body by the detent 28, it returns with the body to the closed position.

It will be apparent that both the opening and closing operations can be carried quickly out with the use of only one hand in a simple and expeditious manner.

While the present invention has been described in connection with a particular embodiment thereof, it will be understood by those skilled in the art that many changes may be made without departing from the true spirit and scope of the present invention. Therefore, it is intended by the appended claims to cover all such changes and modifications which come within the true spirit and scope of this invention.

What is claimed:

1. A clasp knife comprising in combination an elongate body having spaced side walls defining a cavity therebetween, a blade pivotably attached to said body for pivotable movement between a first position wherein it is disposed in said cavity and a second position wherein it extends from said one end of said body, a latching lever pivotably attached to said body for pivotal movement between a first position adjacent said body and a second position extending from said one end of said body, a latching dog pivotably attached to said latching lever, said blade having a notch therein for receiving said dog when said lever is in said second position to lock said blade in said second position, spring means biasing said dog into locking engagement with said blade, and lock actuator means mounted to said body for movement between a first unlocking position for engagement with said latching dog when said lever is in said second position and a second locking position remote from said latching dog.

2. A clasp knife according to claim 1, comprising finger grip means on said lever for facilitating movement of said lever between said first and second positions.

3. A clasp knife according to claim 1, comprising detent means carried by said body for detaining said lever in said first position.

4. A clasp knife according to claim 2, comprising a second detent means carried by said body for detaining said blade in said cavity.

5. A clasp knife according to claim 1, wherein said lock actuator means includes a finger actuator disposed on the exterior of one of said walls.

6. A clasp knife according to claim 5, wherein said lock actuator is moveable in a direction parallel to the longitudinal axis of said blade between said first and second positions.

* * * * *